US006746579B2

(12) United States Patent
Kadota

(10) Patent No.: US 6,746,579 B2
(45) Date of Patent: Jun. 8, 2004

(54) ELECTROLYTIC GOLD PLATING METHOD AND APPARATUS THEREFOR

(75) Inventor: Hiroyuki Kadota, Hitachi (JP)

(73) Assignee: Hitachi Kyowa Engineering Co., Ltd., Hitachi (JP)

( * ) Notice: Subject to any disclaimer, the term of this patent is extended or adjusted under 35 U.S.C. 154(b) by 148 days.

(21) Appl. No.: 09/989,469

(22) Filed: Nov. 21, 2001

(65) Prior Publication Data

US 2003/0094375 A1 May 22, 2003

(51) Int. Cl.[7] ..... C25B 9/00

(52) U.S. Cl. ..... 204/242; 205/80; 205/82; 205/84; 205/266; 205/81; 118/620; 118/688

(58) Field of Search ..... 118/620, 688; 205/80, 82, 84, 266, 81; 204/242

(56) References Cited

U.S. PATENT DOCUMENTS 6,113,769 A 9/2000 Uzoh et al.

FOREIGN PATENT DOCUMENTS

EP 0180090 5/1986

JP 02-110348 4/1990

*Primary Examiner*—Wesley A. Nicolas
(74) *Attorney, Agent, or Firm*—Crowell & Moring LLP

(57) ABSTRACT

An object of the present invention is to provide a method of monitoring deterioration of an electrolytic gold plating solution which can always stably performing gold plating by continuously detecting a deterioration state of the gold sulfite complex plating solution, and to provide an apparatus for monitoring the deterioration of the electrolytic gold plating solution.

The present invention is characterized by an electrolytic gold plating method for performing electrolytic gold plating on a surface of a substrate body using a gold sulfite plating solution, wherein the gold plating is performed while deterioration of the plating solution is being always or intermittently detected during plating. Further, the present invention is characterized by an electrolytic gold plating apparatus for performing electrolytic gold plating on a surface of a substrate body using a gold sulfite plating solution, which comprises a detecting means for always or intermittently detecting deterioration of the plating solution and a monitoring unit for displaying the deterioration degree.

9 Claims, 4 Drawing Sheets

ELECTROLYTIC GOLD PLATING METHOD AND APPARATUS THEREFOR

BACKGROUND OF THE INVENTION

1. Field of the Invention

The present invention relates to a novel electrolytic gold plating method in which a degree of deterioration of a gold plating solution of gold sulfite complex is measured and monitored, and an apparatus for the electrolytic gold plating method.

2. Prior Art

As a conventional electrolytic gold plating method known is the gold cyanide plating method in which gold cyanide complex is used as a major component of the plating solution. Because the gold cyanide plating solution is very stable, abnormal deposition of metallic gold does not occur. However, since cyanic compounds have strong toxicity and accordingly have a problem in the environmental aspect, non-cyanic group plating methods have been developed and practically used.

In recent years, a gold sulfite plating solution having a major component of gold sulfite complex is growing widely used. As described above, the pollution-free electrolytic gold plating has been made possible since the gold sulfite plating solution does not have toxicity and the environmental effects are sufficiently considered. However, although the environmental effects of the gold sulfite plating solution are sufficiently considered, the stability of the solution is not sufficiently stable and accordingly the abnormal deposition of metallic gold is apt to occur during using. The reason exists in the instability of gold sulfite complex. That is, the stability of gold sulfite complex is very small compared to the stability of gold cyanide complex. Gold sulfite complex is deteriorated and decomposed to form univalent free gold ions, and the gold ions form metallic gold through disproportionation reaction. The metallic gold is in a form of very small particles in the initial stage, but the gold particles are growing by coagulation of the particles. Then, metallic gold is abnormally deposited on the surfaces of the components of the apparatus inside the plating bath irrespectively of current-carrying. This phenomenon causes a problem of incapability of normal gold plating. A gold plating solution using gold sulfite complex is disclosed in Japanese Patent Application Laid-Open No. 9-59792, Japanese Patent Application Laid-Open No. 10-251887 and Japanese Patent Application Laid-Open No. 11-61480.

When the gold abnormal deposition described above occurs, the solution must be drained from the plating apparatus to clean the inside of the apparatus. However, gold is a very stable metal, and accordingly, can not be dissolved and removed using an agent such as a common acid. Therefore, the plating apparatus needs to be recovered to the initial condition by performing cleaning. Therefore, this requires a large amount of time and cost, and is extremely uneconomical.

Further, in the above-described gazettes, there is no description on the deterioration of the gold sulfite complex plating solution when gold plating is performed using the solution.

SUMMARY OF THE INVENTION

An object of the present invention is to provide an electrolytic gold plating method which can always stably perform electrolytic gold plating and can prevent incapability of performing electrolytic gold plating by continuously or intermittently detecting a deterioration state of the gold sulfite complex plating solution while the gold plating is being performed using the gold sulfite complex plating solution, and to provide the electrolytic gold plating apparatus.

The present invention is characterized by an electrolytic gold plating method for performing electrolytic gold plating on a surface of a substrate body using a gold sulfite plating solution, the method comprising the steps of detecting a deterioration degree of the plating solution; and performing the plating. It is preferable that the detection of a deterioration degree of the plating solution is performed before starting plating or always or intermittently performed during plating.

In regard to the detection of a deterioration degree, it is preferable to irradiate light to the plating solution and then measure a light intensity of the specific absorption wavelength, preferably, a light intensity of the specific absorption wavelength of 310 nm. It is preferable to perform at least one of detection of an amount of gold colloid formed in the plating solution, measurement of a pH of the plating solution, measurement of sulfurous acid in gold sulfite complex in the plating solution, and measurement of a concentration of sulfuric acid in the plating solution.

Further, the present invention is characterized by an electrolytic gold plating method comprising the step of performing at least one of addition of the plating solution, adjustment of pH, adjustment of sulfurous acid concentration and adjustment of sulfuric acid based on the value obtained by measuring at least one of an amount of gold colloid of said plating solution, a value of pH of the plating solution, a concentration of sulfurous acid in gold sulfite complex in the plating solution and a concentration of sulfuric acid in the plating solution.

The present invention is characterized by an electrolytic gold plating apparatus for performing electrolytic gold plating on a surface of a substrate body using a gold sulfite plating solution, which comprises a detecting means for detecting a deterioration degree of the plating solution, and is also characterized by an electrolytic gold plating apparatus which comprises a monitoring unit for displaying the degree of deterioration. It is preferable that the detection of a deterioration degree of the plating solution is performed before starting plating or always or intermittently performed during plating.

It is preferable that the detecting means comprises at least one of means for irradiating light to the plating solution and measuring a light intensity after the irradiation, means for measuring a pH of the plating solution, means for measuring sulfurous acid in gold sulfite complex of the plating solution, and means for measuring sulfuric acid of the plating solution. It is preferable that the means for measuring the light intensity is an absorptiometer, and that the means for measuring the pH is a pH meter using a glass electrode, and that the means for measuring the sulfurous acid in the complex is an automatic titrator or a liquid chromatograph.

That is, the inventors of the present invention conducted detailed study on gold sulfite plating solution, and found that the absorption characteristic of the plating solution, the pH of the plating solution, the concentration of sulfurous acid and the concentration of sulfuric acid in the plating solution were changed as deterioration of the solution progressed. As deterioration of the solution progressed, the absorption intensity of the specific wavelength of the plating solution is increased, the pH and the concentration of sulfurous acid in the complex are decreased, and the concentration of sulfuric acid is increased. Therefore, these are detected to be used as degrees of the deterioration of the plating solution.

Further, the present invention makes it capable to stably perform gold plating by detecting and analyzing one kind or combination of more kinds of the above-described factors to monitor the deterioration state of the gold sulfite plating solution. It is preferable that the abnormal deposition of gold is predicted to output an alarm.

Furthermore, the present invention is characterized by an electrolytic gold plating apparatus comprising an automatic adding solution supply unit for adding the plating solution based on a value obtained by measuring at least one of an amount of gold colloid of the plating solution, a value of pH of the plating solution, a concentration of sulfurous acid in gold sulfite complex in the plating solution and a concentration of sulfuric acid of the plating solution; an automatic pH adjustment unit for adjusting pH; and an automatic water supply unit for supplying water for evaporated water.

The present invention is effective for the electrolytic gold plating to form lead terminals and wires used in a semiconductor device.

DESCRIPTION OF THE PREFERRED EMBODIMENTS

Embodiment 1

A commercially available gold sulfite plating solution was used as the gold plating solution, and a plating apparatus to be described later was used as the electrolytic gold plating apparatus. A substrate body to be plated used was a 6-inch Si wafer which had an Au solid film formed by sputtering on the surface, and gold plating was performed while the plating solution was being stirred by blowing air into the solution under conditions of liquid temperature of 65° C. and current density of 10 mA/cm$^2$. During plating, the plating solution was sampled 5 times at arbitrary time to measure the light absorption spectrums.

Figure 1:
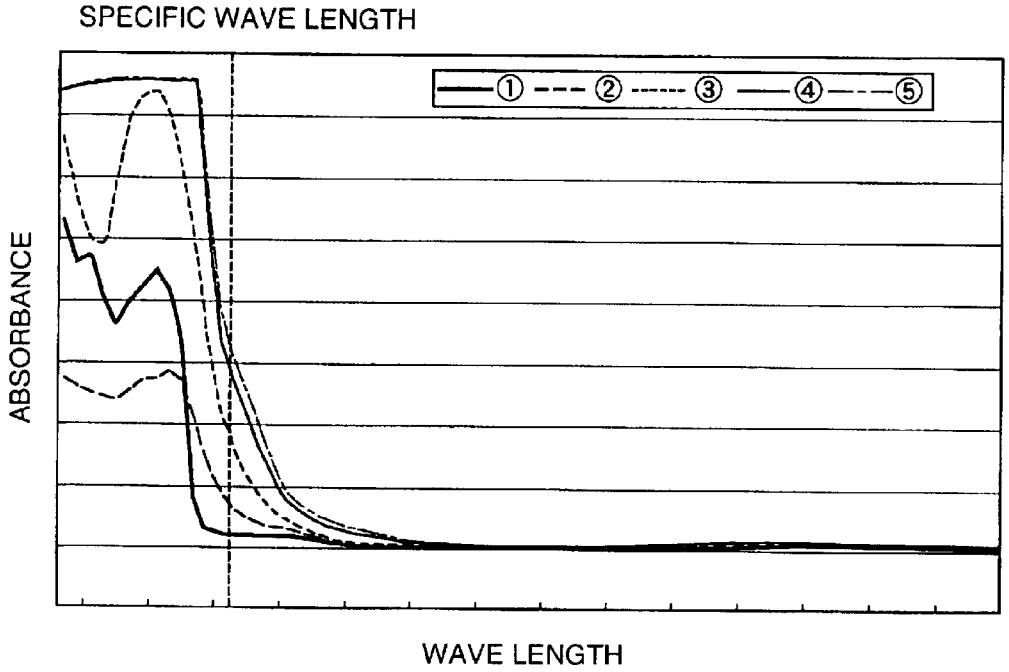
FIG. 1 is a graph showing the change of absorbance of a specific absorption wavelength with time to plating duration time of a gold sulfite complex plating solution

FIG. 1 is a graph showing the relationship between absorbance and wavelength. The line ① shows the absorption spectrum of the new gold sulfite plating solution, and the lines ②, ③, ④ and ⑤ show the absorption spectrums in ascending order of the gold plating time. The absorption intensity of the specific absorption wavelength of 310 nm indicated in the figure became larger as the gold plating was continued, and abnormal deposition of gold was observed after the plating time exceeded a certain time. From this result, it was found that the deterioration of gold plating solution could be detected by measuring the absorption intensity of the specific absorption wavelength.

Embodiment 2

Deterioration of gold sulfite plating solution due to oxidation was measured under conditions of liquid temperature of 65° C. using a commercially available gold sulfite plating solution as the gold plating solution while air was being blown into the solution. Sulfurous acid is an unstable material against oxidation, and gold sulfite complex is also decomposed by being oxidized according to Equation (1).

$$Au(SO_3)_2^{3-}+O_2 \rightarrow Au(I)+2SO_4^{2-} \quad (1)$$

As the result, univalent gold is formed. Further, the univalent gold ions become non-ionized gold and trivalent gold through the disproportionation reaction shown by Equation (2).

$$3Au(I) \rightarrow 2Au(0)+AU(III) \quad (2)$$

The non-ionized gold produced there is metallic gold which causes the abnormal deposition. Therefore, taking the change in the amount of sulfurous acid due to the oxidation expressed by Equation (1) into consideration, the inventors of the present invention sampled the plating solution at arbitrary time while air was being blown into the gold plating solution, and measured concentration of sulfurous acid in the sample.

Figure 2:
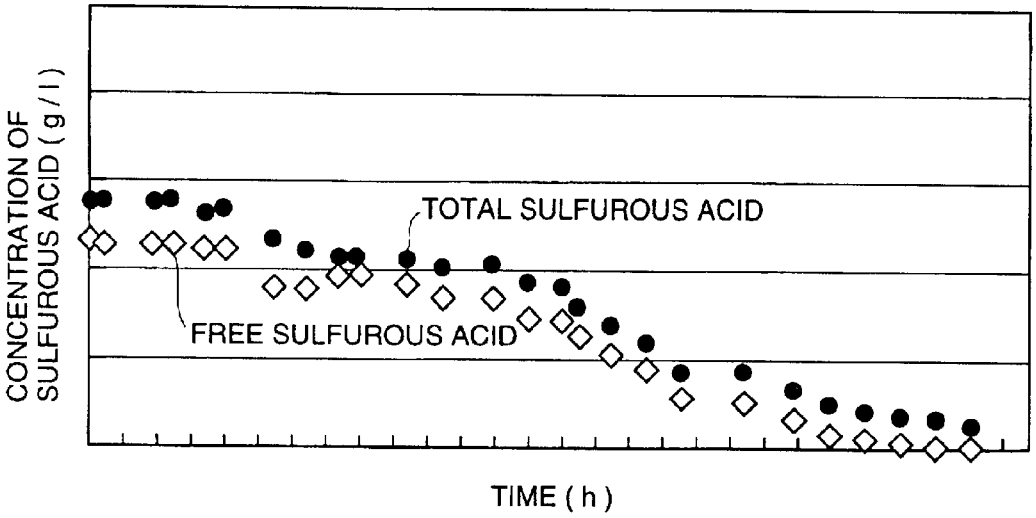
FIG. 2 is a graph showing the change of concentration of sulfurous acid with time to air oxidization of the gold sulfite complex plating solution.

FIG. 2 is a graph showing change with time of the concentration of sulfurous acid. There, the total sulfurous acid is the concentration of sulfurous acid measured through iodine titration, and the free sulfurous acid is the concentration of sulfurous acid measured by an ion-exclusion liquid chromatograph using a cation-exchange resin, and the sulfurous acid in the complex is calculated by subtracting the free sulfurous acid from the total sulfurous acid. It can be understood that the concentrations of the total sulfurous acid and the free sulfurous acid are decreased as time elapses. Further, the concentration of the sulfurous acid in the complex is also decreased within a certain range in proportion to the decrease of the total sulfurous acid. It is clear from the result that the deterioration degree of the gold plating solution can be detected by measuring the concentration of the total sulfurous acid or the concentration of the free sulfurous acid in the plating solution.

Embodiment 3

Figure 3:
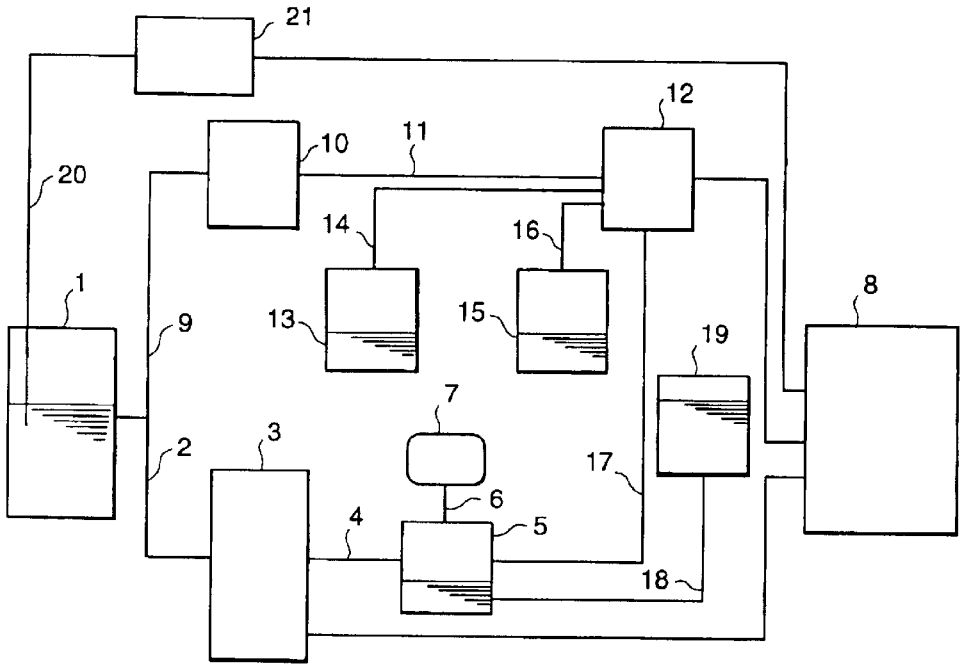
FIG. 3 is a block diagram showing the details of a vertical holder type electrolytic gold plating apparatus in accordance with the present invention.

FIG. 3 is a block diagram showing the details of a vertical holder type electrolytic gold plating apparatus having a monitoring unit in accordance with the present invention. The plating solution is introduced from a plating bath 1 into an absorptiometer 3 through a sampling pipe 2. The apparatus has such a construction that the inside of a tank 5 may be brought in a negative pressure condition through a pipe 6 by starting operation of a vacuum pump 7 to suck the transported solution into the absorptiometer 3 from the plating bath 1 in order to prevent the plating solution from directly contacting with a pump. The absorptiometer 3 is an instrument for measuring the absorption intensity of the specific absorption wavelength of 310 nm of the plating solution, and the deterioration degree of the plating solution is measured by inputting the data to a control personal computer 8. One of the results has been shown in Embodiment 1.

Further, at the same time as the above, a given amount of the plating solution is sampled from the plating bath 1 through a sampling pipe 9 using a pipetter 10 to be transferred to an automatic titrator 12 through a sampling pipe 11. The automatic titrator 12 receives the sampled plating solution, and then an iodine solution is pipetted to the automatic titrator 12 by a pipetter 13 through a pipe 14, and an acetic acid—sodium acetate buffer solution is also pipetted to the automatic titrator 12 by a pipetter 15 through a pipe 16. After that, in the automatic titrator 12, measurement of concentration of sulfurous acid in the gold plating solution is started, and after completion of the measurement the deterioration degree of the gold plating solution is measured by inputting the data into the control personal computer 8. The solution completed to be measured is drained to the tank 5 through a pipe 17 by starting operation of the vacuum pump 7 to make the inside of the tank 5 through the pipe 6 into a negative pressure condition. Waste solution and the like stored in the tank 5 are drained to a drain tank 19 through a pipe 18 after the vacuum of the tank 5 is broken. The method of measuring sulfurous acid concentration through iodine titration of the automatic titrator 12 is performed according to K0101 of the JIS.

Further, at the same time as the above, the pH of the gold plating solution is measured using a pH meter 21 by inserting a pH measuring glass electrode into the gold plating solution of the gold plating bath 1. The measured value is input to the control personal computer 8 to measure the deterioration degree of the plating solution.

Although the measurement of deterioration degree can be performed one of the analysis means of gold plating solution described above, the deterioration degree of the gold plating solution can be detected more accurately by combining the above means.

The plating apparatus described above comprises an anode which is vertically arranged in the plating bath; an object to be plated which is vertically arranged opposite to said anode; an opening portion which is arranged at a side surface portion of the plating bath; a substrate stage for vacuum-holding the object to be plated, the substrate stage detachably attached to the plating bath in a state of blocking the opening portion; and a pushing unit for pushing and releasing the substrate stage to and from the opening portion, wherein the object to be plated is placed inside the plating bath to be brought in contact with the plating solution in the plating bath.

According to the present embodiment, highly accurate deterioration monitoring can be performed by cross-monitoring of the solution deterioration caused by oxidation of sulfite complex and the gold deposition caused by the disproportionation reaction of gold ions. Further, time of replacing the plating solution can be appropriately judged by the monitoring. Furthermore, the availability of the plating apparatus can be improved because cleaning of the apparatus due to the abnormal deposition can be eliminated. Further, timing of supplying water can be appropriately set by measuring an integrated current value and a concentration of gold.

Further, the present plating apparatus is constructed in that the plating apparatus comprises a plating reservoir connected to the plating bath to contain the plating solution in the plating bath, and has a capacity enough to fill up the plating bath so that the surface level of the plating solution may reach a position higher than the upper end of the opening portion described above; that the plating apparatus comprises a plating solution stirring mechanism arranged at a position near the opening portion in the plating bath; that the opening portion described above is formed on a detachable side plate which composes the plating bath; that the pressing unit is capable of rotating and moving the substrate stage; that the substrate stage is detachable from a stage main body, and a plated object vacuum holding portion for vacuum holding an object to be plated is mounted on the stage main body and is detachable from the stage main body; that the substrate stage has a substrate stage pushing power portion, and a sphere bearing is arranged in the substrate stage pushing power portion; and that the sphere bearing rotates and closely attaches a seal portion of the substrate stage against the opening portion when the substrate stage is pushed against the opening portion, and is fixed when the object to be plated is held on the substrate stage.

Figure 4:
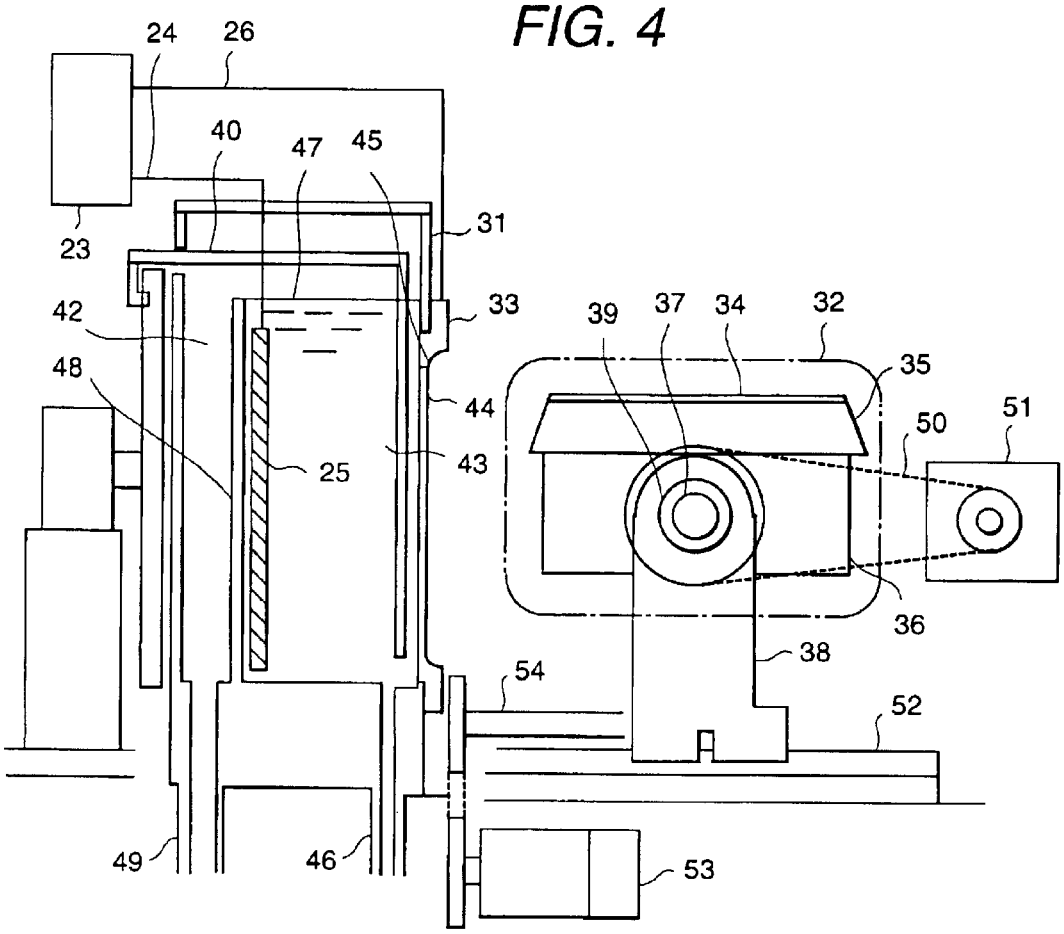
FIG. 4 is a cross-sectional view showing an embodiment of a plating apparatus in accordance with the present invention.

FIG. 4 is a cross-sectional view showing the plating apparatus used in the above-mentioned embodiment. The plating apparatus comprises the plating bath 31 and the substrate stage 32. The plating bath 31 is formed in a box shape and made of a resin, and has the circular opening portion 33 in the side surface portion. Further, the plating bath 31 has a partition plate 48 in the inside to divide the plating bath into two sections. A plating solution drain pipe 49 is connected to one of the rooms 42, and a plating solution inlet pipe 46 is connected to the other of the rooms. When the circular opening portion 33 is closed by the substrate 34, the room 43 is filled with the plating solution 47 so as that the plating solution flows over the partition plate 48. The plating apparatus comprises the unit for measuring deterioration of the plating solution and the control personal computer 8 shown in FIG. 3, but these are not shown in the figure.

A cathode electrode 45 is arranged at a position near the opening 44 of the circular opening portion 33. Further, in the plating bath 31, a plating solution stirring machine 40 including a plating solution stirring member arranged between the substrate 34 and the anode plate 25 is provided. By arranging such a plating control mechanism, it becomes easy to control the plating film thickness distribution.

The substrate stage 32 is formed by combining a substrate table 35 having the vacuum holding mechanism for the substrate 34 and a body portion 36 as the stage main body and the rotating shaft 37, and the rotating shaft 37 is rotatably supported by a bearing 39 contained in a bracket 38 to rotate the substrate stage 32 from a horizontal position to a vertical position using a motor 51 through a power transmission belt 50. The reverse operation is also possible. The bracket 38 is arranged on a rail 52, and moved by a motor 53 through a ball screw 54. The substrate table 35 is pushed against the circular opening portion using the substrate stage pushing power portion to close the opening 44, as to be described later.

The circular opening portion 33 is detachably attached onto the side plate of the plating bath 31. Since the circular opening portion 33 of the plating bath 31 and the substrate table 35 as the plated object vacuum holding portion of the substrate stage 34 are detachable from the plating bath, plural kinds of semiconductor substrates (objects to be plated) having different diameters can be plating processed using a single apparatus.

The plating bath 31 and the substrate stage 34 are paired in one unit. Therefore, the arrangement and the structure can be changed corresponding to a plating process, and accordingly, an expandable fully automatic plating apparatus cab be provided. It is possible that a semiconductor substrate (an object to be plated) is fully automatically taken out from a cassette, and then finally returned to the cassette after completing a series of plating processes.

Plating is performed by horizontally positioning and vacuum holding an object to be plated in the outside of the plating bath 31, and rotating the vacuum held object to be plated to be vertically set at the opening portion provided on the side surface of the plating bath, and then pouring the plating solution into the plating bath. The plating is performed by bring one side surface of the object to be plated in contact with the plating solution and vacuum holding the other side surface under the atmospheric environment outside the plating bath. The object to be plated is held in the cassette under the atmospheric environment, and horizontally set under the atmospheric environment, and rotated and moved under the atmospheric environment.

The plating is performed by taking out a semiconductor substrate from a substrate cassette under the atmospheric environment and horizontally positioning the semiconductor substrate, and rotating and moving the substrate stage under the atmospheric environment to vertically setting the semiconductor substrate opposite to the anode plate vertically arranged inside the plating bath, and bring one side surface of the semiconductor substrate in contact with the plating solution.

Figure 5:
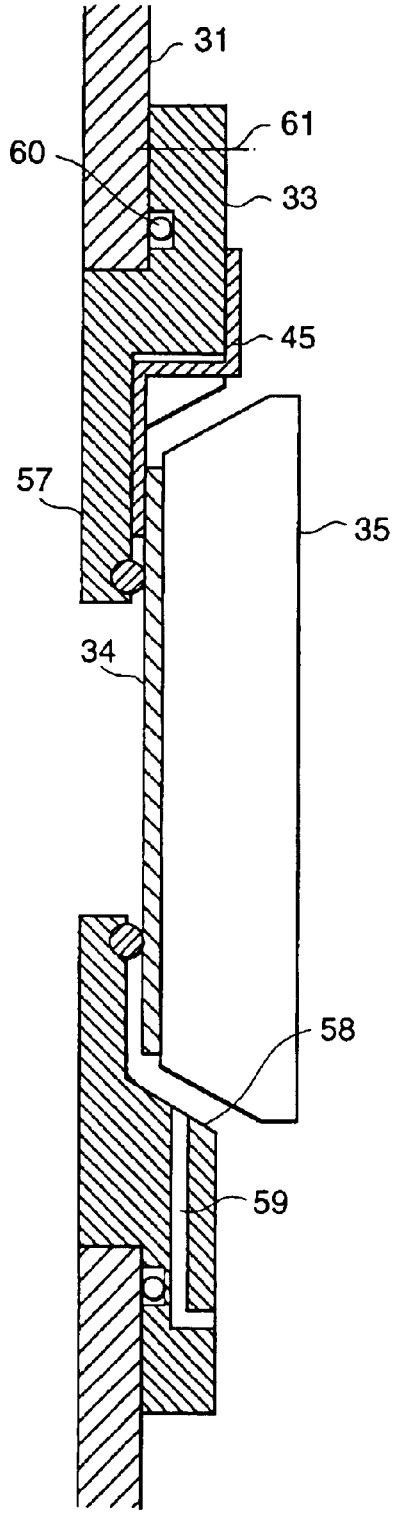
FIG. 5 is a detailed view showing a circular opening portion of the plating bath.

FIG. 5 is a detailed view showing the circular opening portion 33 of the plating bath 31. The circular opening portion 33 on the side surface of the plating bath 31 has the cathode electrode 45 for conducting current from a plating power supply 23 and a seal mechanism 57 for sealing between the substrate 34 and the plating bath 31. Further, the circular opening portion 33 has a tapered guide portion 58 for suppressing displacement when the substrate table 5 is pushed to the circular portion, and also has a waste liquid port 59 for collecting a small amount of the plating solution leaked outside to one position.

Furthermore, since the circular opening portion 33 has a packing 60 and fixed to the plating bath 31 with bolts 61, the cathode electrode 45 and the seal mechanism 57 can be easily exchanged at scheduled exchanging by removing the circular opening portion 33. In addition, by replacing only the circular opening portion 33 without exchanging the main body of the plating bath 31, the plating apparatus can be cope with processing of substrates having various kinds of diameters. The present plating apparatus has the following effects.

1) A high quality plating film surface can be formed because suppressing the effect of remaining of bubbles on the plated surface and the effect of separation and fallout of a black film from the anode plate by adjusting and vertically setting the object to be plated.
2) Plated film thickness distribution can be easily controlled because the plating process adjusting mechanism can be arranged between the object to be plated and the anode plate arranged vertically and opposite to the object to be plated.
3) Design aiming the fully automated plating apparatus can be easily performed because a holder for holding the object to be plated used in the conventional dip type apparatus can be eliminated by employing the structure that the object to be plated is held by being pressed and pushed to the opening portion on the side surface of the plating bath using the substrate stage.
4) Plating processing of plural kinds of semiconductor substrates (objects to be plated) having different diameters can be performed by a single plating apparatus by making the opening portion provided in the side plate of the plating bath and the plated object vacuum holding portion of the substrate stage detachable.
5) An expandable fully automatic plating apparatus can be provided because the plating bath and the substrate stage are paired in one unit.

The effects are large in the points of the improvement of the throughput of plating work, the easiness of connection to the front and the rear plating processes, the improvement of quality of the plated films and the space saving of the apparatus installation because a semiconductor substrate an object to be plated) can be fully automatically taken out from a cassette, and then finally returned to the cassette after completing a series of plating processes.

The present embodiment can be similarly applied to a plating apparatus of a vertical holder type.

The present embodiment can form uniform films in an electrolytic gold plating for forming lead terminals and wires used in a semiconductor device, and can form plating film without unevenness to each plating film in continuous plating film forming.

Embodiment 4

In addition to Embodiment 3, this embodiment further comprises an absorptiometer for irradiating light to the plating solution and measuring a light intensity after the irradiation; a pH meter for measuring a pH of the plating solution; a concentration measurement unit consisting of an automatic titrator or a liquid chromatograph for measuring a concentration of at least one of sulfurous acid or sulfuric acid in the plating solution; an automatic adding solution supply unit for adding the plating solution based on a value obtained by measuring at least one of an amount of gold colloid of the plating solution, a value of pH of the plating solution, a concentration of sulfurous acid in gold sulfite complex in the plating solution and a concentration of sulfuric acid of the plating solution using the above-described instruments; an automatic pH adjustment unit for adjusting pH; and an automatic water supply unit for supplying water for evaporated water.

The present embodiment can also form uniform films in an electrolytic gold plating for forming lead terminals and wires used in a semiconductor device, and can form plating film without unevenness to each plating film for a long time in continuous plating film forming.

According to the present invention, since the deterioration state of a gold sulfite complex plating solution is continuously or intermittently detected while the gold plating is being performed, it is possible to stably perform the gold plating and to prevent incapability of performing electrolytic gold plating.

What is claimed is:

1. An electrolytic gold plating apparatus for performing electrolytic gold plating on a surface of a substrate body using a gold sulfite plating solution, comprising a detector configured to detect a deterioration degree of said gold sulfite plating solution in which light is irradiated to said gold sulfite plating solution and light intensity is measured after the light is irradiated.

2. An electrolytic gold plating apparatus for performing electrolytic gold plating on a surface of a substrate body using a gold sulfite plating solution, comprising means for irradiating light to said gold sulfite plating solution and measuring a light intensity after said irradiation, and at least one of means for measuring a pH of said gold sulfite plating solution, means for measuring sulfurous acid in gold sulfite complex of said gold sulfite plating solution, and means for measuring sulfuric acid of said gold sulfite plating solution.

3. An electrolytic gold plating apparatus according to claim 2, wherein said means for measuring said light intensity is an absorptiometer.

4. An electrolytic gold plating apparatus according to any one of claims 2 and 3, wherein said means for measuring said pH is a pH meter using a glass electrode.

5. An electrolytic gold plating apparatus according to claim 2 or 3, wherein said means for measuring said sulfurous acid in said complex or sulfuric acid is an automatic titrator or a liquid chromatograph.

6. An electrolytic gold plating apparatus according to claim 2 or 3, which comprises a monitoring unit for displaying a value measured by at least one of said means for measuring a light intensity, said means for measuring said pH1, said means for measuring sulfurous acid and said means for measuring sulfuric acid.

7. An electrolytic gold plating apparatus for performing electrolytic gold plating on a surface of a substrate body in a gold plating bath containing a gold sulfite plating solution, which comprises:

an absorptiometer for irradiating light to said plating solution and measuring a light intensity after said irradiation;

a pH meter for measuring a pH of said plating solution;

a concentration measurement unit consisting of an automatic titrator or a liquid chromatograph for measuring a concentration of at least one of sulfurous acid or sulfuric acid in said plating solution;

pipes for individually connecting said absorptiometer, said pH meter and said concentration measurement unit to said gold plating bath, said pipes making said plating solution to pass through; and a personal computer for displaying quality of said plating solution based on a value measured by at least one of said absorptiometer, said pH meter and said concentration measurement unit.

8. An electrolytic gold plating apparatus according to claims 1 to 3 and 7, which comprises:

an automatic adding solution supply unit for adding said plating solution based on a value obtained by measuring at least one of an amount of gold colloid of said plating solution, a value of pH of said plating solution, a concentration of sulfurous acid in gold sulfite complex of said plating solution and a concentration of sulfuric acid of said plating solution;

an automatic pH adjustment unit for adjusting pH; and an automatic water supply unit for supplying water for evaporated water.

9. An electrolytic gold plating apparatus according to claims 1 to 3 and 7, which comprises:

an anode, an object to be plated and an opening portion in a plating bath, said anode being vertically arranged, said object to be plated being arranged opposite to said anode, said opening portion being arranged at a side surface portion of said plating bath;

a substrate stage for vacuum-holding said object to be plated, said substrate stage detachably attached to said plating bath in a state of blocking said opening portion; and a pushing unit for pushing and releasing said substrate stage to and from said opening portion.

* * * * *